US008042555B2

(12) United States Patent
Neuner et al.

(10) Patent No.: US 8,042,555 B2
(45) Date of Patent: Oct. 25, 2011

(54) HEAD FOR A COSMETIC APPLICATOR

(75) Inventors: Charles P. Neuner, Amityville, NY (US); William Bickford, Ronkonkoma, NY (US); Herve F. Bouix, New York, NY (US)

(73) Assignee: ELC Management LLC, New York, NY (US)

( * ) Notice: Subject to any disclaimer, the term of this patent is extended or adjusted under 35 U.S.C. 154(b) by 667 days.

(21) Appl. No.: 11/850,120

(22) Filed: Sep. 5, 2007

(65) Prior Publication Data

US 2009/0056737 A1 Mar. 5, 2009

(51) Int. Cl.
*A45D 40/26* (2006.01)
*A45D 40/24* (2006.01)

(52) U.S. Cl. ..... 132/218; 132/320

(58) Field of Classification Search ..... 132/320, 132/217–219, 107, 120, 126, 142, 318; 401/268, 401/11, 129, 126; 15/160, 186–188, 206–207.2
See application file for complete search history.

(56) References Cited

U.S. PATENT DOCUMENTS

| | | | | |
|---|---|---|---|---|
| 381,749 | A | | 4/1888 | Ashburner |
| 914,501 | A | | 3/1909 | McEachern |
| 1,963,389 | A | | 6/1934 | Vardeman |
| D110,517 | S | | 7/1938 | Goldman |
| D146,271 | S | | 1/1947 | Stavely |
| D190,067 | S | | 4/1961 | Reedy |
| 3,343,551 | A | | 9/1967 | Anderson |
| 3,648,321 | A | | 3/1972 | Vallis |
| D224,187 | S | | 7/1972 | Klepper |
| 3,960,154 | A | | 6/1976 | Pollard |
| 4,458,701 | A | | 7/1984 | Holland |
| 4,565,205 | A | | 1/1986 | Taylor |
| 4,804,004 | A | * | 2/1989 | Taylor ..... 132/218 |
| 4,964,429 | A | | 10/1990 | Cole |
| 5,054,154 | A | | 10/1991 | Schiffer et al. |
| D346,697 | S | | 5/1994 | O'Conke |
| D393,748 | S | | 4/1998 | Peltier |
| 5,853,010 | A | | 12/1998 | Suh |
| D423,228 | S | | 4/2000 | Chen |

(Continued)

FOREIGN PATENT DOCUMENTS

EP 1454561 9/2004

(Continued)

OTHER PUBLICATIONS

PCT International Search Report; International Application No. PCT/US08/071866; Completion Date: Dec. 16, 2008; Date of Mailing: Dec. 16, 2008.

(Continued)

*Primary Examiner* — Todd Manahan
*Assistant Examiner* — Brianne O'Neill
(74) *Attorney, Agent, or Firm* — Cynthia Miller

(57) ABSTRACT

An applicator for applying a cosmetic to keratinous material is provided. The applicator is a single-piece molded unit formed of a single material and includes a slim, tapered head portion, having an arcuate configuration. The head portion comprises a support and at least two rows of projecting tines integrally molded therewith. The tines extend transversely away from one side of the support relative to the longitudinal axis of the head, the opposite side of the support being smooth and free from tines. The arcuate and tapered shape of the support facilitates the application of cosmetic product to the eyelash fringe including the shortest eyelashes located in the corners of the eye.

25 Claims, 10 Drawing Sheets

U.S. PATENT DOCUMENTS

| | | | | |
|---|---|---|---|---|
| D423,229 | S | 4/2000 | Chen | |
| 6,412,496 | B1 | 7/2002 | Gueret | |
| 6,539,950 | B1 | 4/2003 | Gueret | |
| 6,546,937 | B2 | 4/2003 | Gueret | |
| 6,581,610 | B1 | 6/2003 | Gueret | |
| 7,134,799 | B2 | 11/2006 | Gueret | |
| 7,325,550 | B2 * | 2/2008 | Eckers et al. | 132/218 |
| 7,337,785 | B2 | 3/2008 | Gueret | |
| 7,581,898 | B2 * | 9/2009 | Gueret | 401/129 |
| 2003/0089379 | A1 * | 5/2003 | Gueret | 132/218 |
| 2003/0213498 | A1 | 11/2003 | Gueret | |
| 2004/0161285 | A1 | 8/2004 | Gueret | |
| 2004/0226573 | A1 | 11/2004 | Gueret | |
| 2004/0237996 | A1 | 12/2004 | Fischer et al. | |
| 2005/0150509 | A1 * | 7/2005 | Gueret | 132/217 |
| 2006/0002758 | A1 | 1/2006 | Gueret | |
| 2006/0065282 | A1 | 3/2006 | Hartstock et al. | |
| 2006/0070635 | A1 | 4/2006 | Dumier et al. | |
| 2006/0093425 | A1 | 5/2006 | Gueret | |
| 2008/0178901 | A1 * | 7/2008 | Montoli | 132/218 |

FOREIGN PATENT DOCUMENTS

| | | |
|---|---|---|
| JP | 2003125842 | 5/2003 |
| WO | WO 2006/057438 | 6/2006 |

OTHER PUBLICATIONS

PCT Written Opinion of the International Searching Authority, or the Declaration; International Application No. PCT/US08/071866; Completion Date: Dec. 16, 2008; Mailing Date: Dec. 16, 2008.

* cited by examiner

HEAD FOR A COSMETIC APPLICATOR

The present invention relates generally to devices for applying a cosmetic substance to keratinous materials, such as eyelashes, eyebrows or hair, and specifically, to a molded cosmetic applicator with a head portion designed to facilitate a more efficient application of cosmetic product, for example, mascara, to keratinous materials, such as the eyelashes.

Cosmetic materials, especially those applied to the eyelashes and eyebrows, have become an indispensable part of the cosmetic treatment of the female face, providing a beautiful frame for the eyes. There are various applicator devices for applying cosmetic products to eyelashes and eyebrows. Conventional twisted-wire brushes are rapidly becoming outmoded due to the limitations in their performance as a result of the constraints of brush-making technology. Molded applicators, which can provide virtually unlimited geometry and performance variations, are replacing such devices. Molded applicators can provide the brush-like application characteristics consumers expect with added performance advantages.

Nevertheless, there exists a need to further improve the performance of molded applicators and the effects they produce. For example, it would be desirable to provide an applicator with one or more or enhanced application features, including improved combing and/or lash separating action, and wiping and product payoff characteristics. In particular, there exists a need for an applicator head which is ergonomically designed to address the curve of the eyelashes as arrayed along the eyelids while providing improved access to the shortest eyelashes located in the corners of the eyes. It would also be desirable to provide an applicator having a head portion having a slim profile to provide the least obstructed view of the eyelashes in any reflective surface which may be employed by the user to facilitate application.

Additionally, it would be desirable to provide a molded applicator with fewer components and/or an applicator which is readily insertable into a cap for a cosmetic package.

SUMMARY OF THE INVENTION

In accordance with one aspect of the present invention, there is provided an applicator for applying a cosmetic to keratinous material, the applicator being of single-piece molded unit construction. The applicator includes a head portion at one end thereof comprising a support having a distal end and a proximal end and defining a radius of curvature. The support has first and second opposite sides and at least two rows of tines disposed along a longitudinal axis of the head portion and projecting transversely away from one side of the support, the opposite side being smooth and free from tines. The major axes of at least some of the tines are parallel to one another, and the rows of the tines define spaces configured to receive and separate the eyelashes and to receive and deliver the desired amount of product to the keratinous material. The molded applicator is formed of a single material.

In accordance with one embodiment of the invention, the applicator comprises a single-piece molded unit suitable for securing to a cap for a cosmetic package. In accordance with a further embodiment of the invention, the applicator is adapted to be connected to a rod or stem which is in turn adapted to be secured to a cap for a cosmetic package.

In accordance with another aspect of the invention, there is provided a packaging and applicator device for applying a product to keratinous material comprising a receptacle for containing the product and an applicator as described herein.

DESCRIPTION OF THE PREFERRED EMBODIMENTS

Reference will now be made in detail to exemplary embodiments of the invention, examples of which are illustrated in the accompanying drawings. For purposes of illustration only, the present invention will be described as used in conjunction with a mascara package, shown in FIGS. 1 and 2. It will be apparent to one of ordinary skill in the art that the present disclosure may be adapted for use with any cosmetic product, e.g. cake, liquid, cream, and paste formulations, to be applied to keratinous materials including the eyelashes, the eyebrows and the hair.

Figure 1:
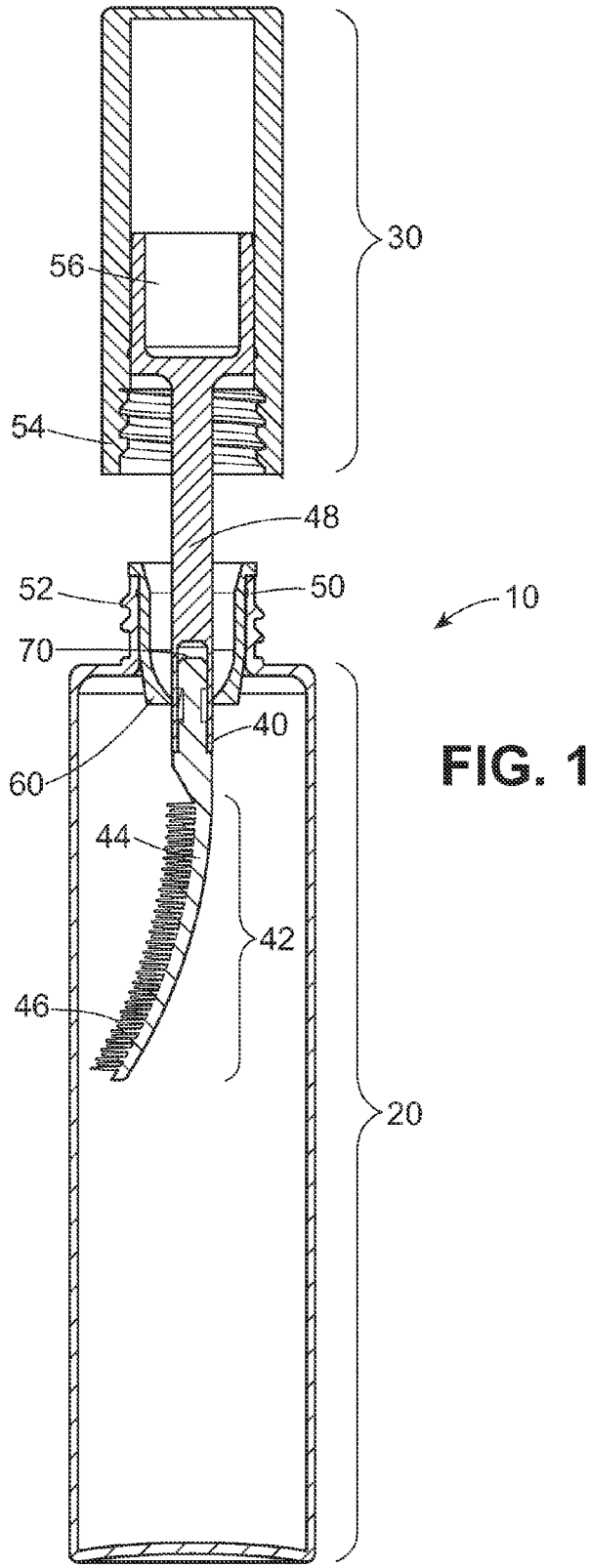
FIGS. 1 and 2 are sectional views of the applicator of the present invention as used within a cosmetic package.
Figure 2:
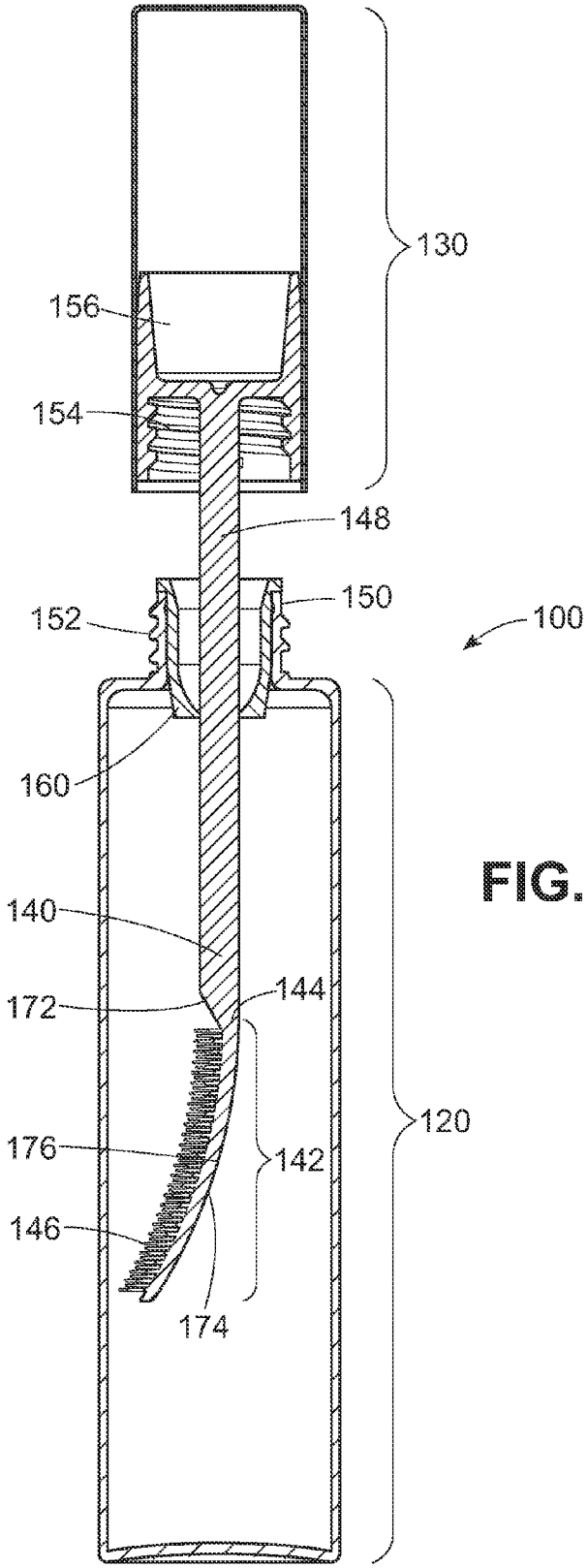

A mascara package 10,100, as seen in FIGS. 1 and 2, generally comprises a receptacle 20,120 for containing cosmetic product, a cap 30,130 for closing the receptacle 20,120, and a molded applicator 40,140. The applicator 40,140, including a head 42,142, comprising a support 44,144 and tines 46,146, is attached to the underside of the cap 30,130, and is adapted to project into the receptacle 20,120. Tines 46,146 project from the concave side 76,176 of the support 44,144. Support 44,144 is smooth on its convex side 74,174. As shown in FIG. 1, the applicator 40 is secured to cap 30 by a rod 48. As shown in FIG. 2, the applicator 140 has a one-piece unitary molded construction including a rod-like portion 148 which is readily securable to the cap 130. The receptacle 20,120 has a neck 50,150 which extends axially from one end of the receptacle 20,120, said neck 50,150 providing access to the contents of the receptacle 20,120. Means 56,156 is provided for attaching the cap 30,130 to the neck 50,150 of receptacle 20,120, and may include opposing threads on external wall 52,152 of the neck 50,150 and on internal wall 54,154 of the cap 30,130. Other means for attaching cap 30,130 to receptacle neck 50,150 are known and may also be used with the same result, for example, a snap closure, or a lug style closure. As shown in FIG. 1, the threaded closure means 56 is built into the cap, and rod 48 is directly inserted e.g., snapped, into cap 30, independent of the closure means.

Alternatively, as shown in FIG. 2, the mascara package 100 may include a one-piece closure means 156 associated with both the cap 130 and the rod-like portion 148. The closure means 156 is adapted to be inserted into the cap 30, and rod-like portion 148 directly engages closure means 156. The receptacle 20,120 may include a wiper member 60,160 which may be removably inserted into the neck 50,150, for wiping the applicator head 42,142 and rod 48 or rod-like portion 148 when the applicator 40,140 is being removed from the receptacle 20,120.

Figure 3:
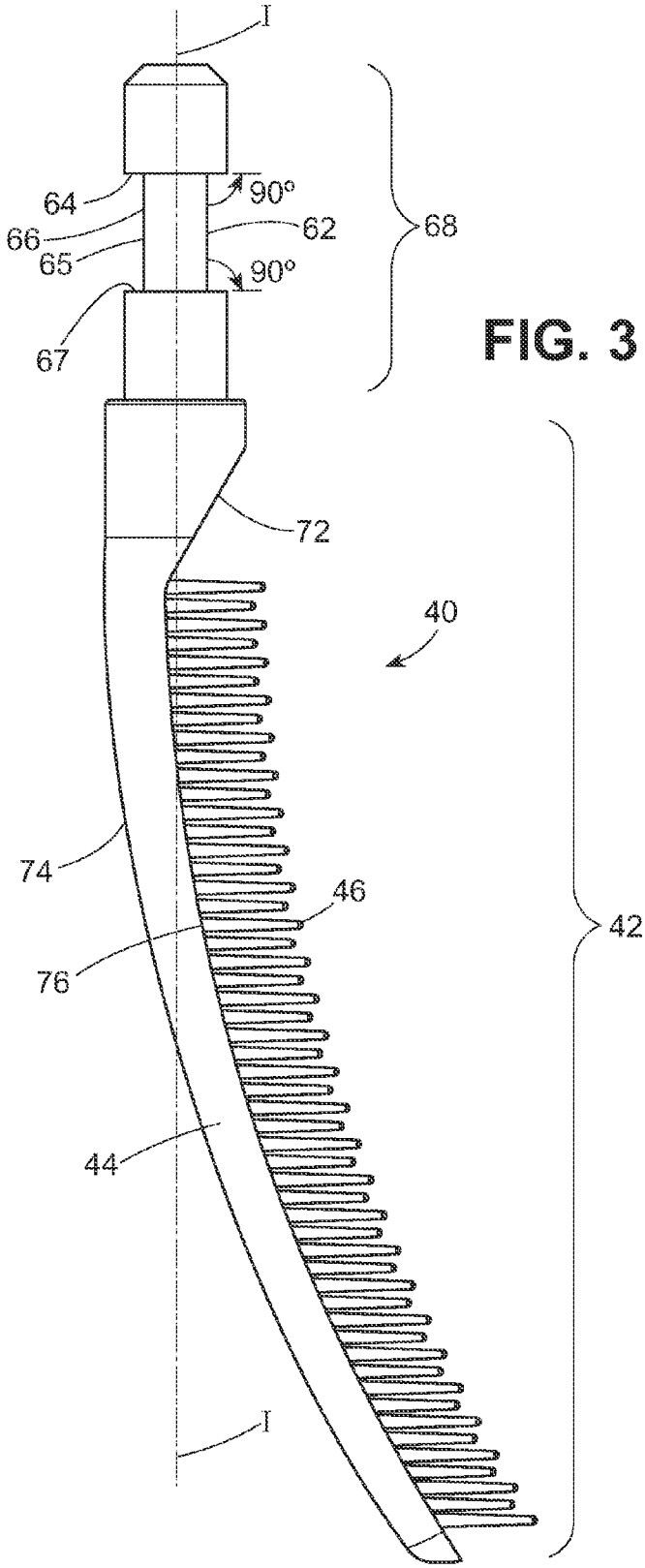
FIG. 3 is a side elevational view of the applicator of FIG. 1 showing a mounting post integrally molded therewith at one end thereof.
Figure 4:
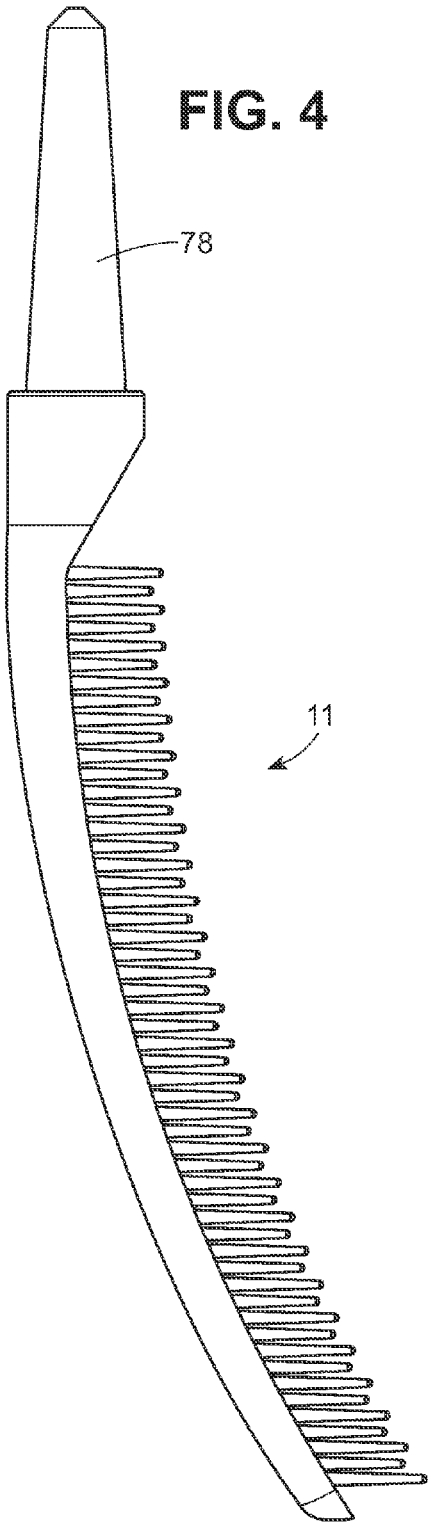
FIGS. 4 and 5 are side elevational views of further embodiments of applicators according to the present invention showing alternative mounting posts integrally molded therewith at one end thereof.
Figure 5:
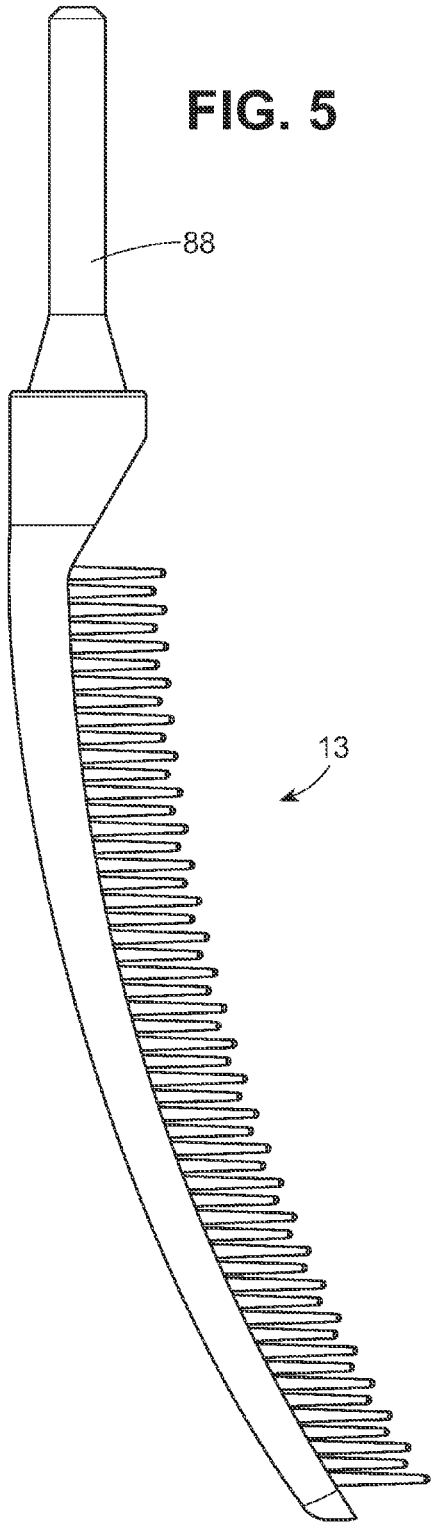

The head 42 of the applicator 40 of FIG. 1 can be secured to the rod 48 by means of mechanical and/or adhesive connection. The applicator 40, as shown in FIG. 1, and, in greater detail in FIG. 3, may incorporate a mounting means utilizing a groove 62 with 90-degree surfaces 64,66,65,67 located along a mounting post 68 which allows the applicator 40 to be mounted without orientation to the rod 48 and which prevents the applicator 40 from pulling loose in use with a retention force approaching and/or exceeding tensile failure of the mounting means of the applicator 40. Therefore, in accordance with one embodiment of the invention, shown in FIGS. 1 and 3, the head portion 42 of the applicator 40 is integrally molded with the mounting post 68 and is securable to a rod 48. The mounting post 68 of applicator 40 may be physically snapped into shallow bore 70 in rod 48 and/or rod 48 can be crimped into groove 62 on mounting post 68. Alternatively, mounting post 68 of applicator 40 can be ultrasonically or induction welded to the rod 48, or otherwise adhered to the rod 48 by means known to those skilled in the art. The mounting post 68 may assume any shape which would, by conventional manufacturing and assembly technologies, result in a secure connection to rod 48. As examples, alternative mounting posts 78,88 for applicators 11,13 are shown in FIGS. 4 and 5. In accordance with a further embodiment of the invention (not shown) one end of the rod may be integrally molded with the mounting post, and the mounting post securable to the proximal end of the applicator by the mechanical/adhesive means described above. For example, the mounting post may be receivable in a shallow bore in the proximal end of the applicator. Preferably, the applicator 40,140 includes a transition portion 72,172 which serves to isolate the tines 46,146 from the rod 48 or rod-like portion 148 and accumulate product for a more effective and cleaner application of the product to keratinous materials.

Figures 6, 6A:
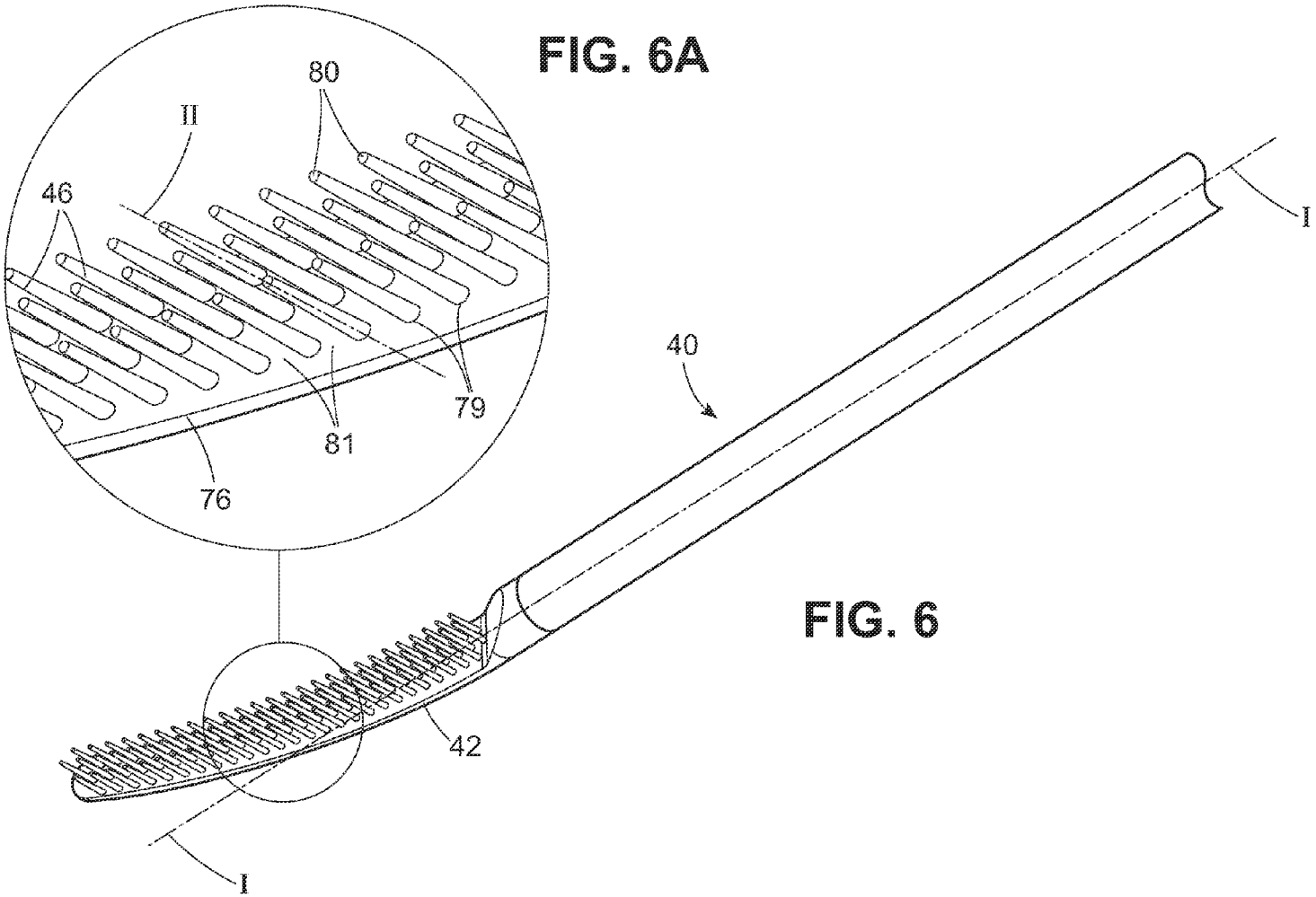
FIG. 6 is a side elevational view of the applicator of in FIG. 1 with a detailed view of a portion of the applicator head.

In accordance with the present invention, arcuate head 42 has a length of from about 5 mm to about 35 mm, preferably from about 20 to about 30 mm, and a radius of curvature in the range of from about 20 min to about 1000 mm, preferably in the range of about 20 to about 60 mm for a mascara applicator, and preferably in the range of about 50 to about 200 mm for a brow product applicator. As shown in FIGS. 3 and 6, tines 46 are arranged along the head 42, on the concave side 76 of the support 44, while the convex side 74 of the support 44 is smooth and free of tines 46. The tines project from the concave side 76 of the head 42 in a direction which is perpendicular to the longitudinal axis I of the applicator. In an alternate embodiment of the present invention, not shown, the convex side of the support is provided with tines, while the concave side of the support is smooth and free of tines. On withdrawal of the applicator 40 from the receptacle 20, the smooth side 74 of support 44 contacts the wiper member 60, and will be wiped clean. With only one side of the applicator 42 head charged with product, the formula can be concentrated where needed on the tines 46.

As also shown in FIG. 6, the applicator head 42 is constructed with a slim profile. Tines 46 extend along the concave side 76 of support, the tines 46 each having a major axis 11, and extending from a base 79 associated with the concave side 76 of support 44 and terminating in a free end 80. The major axes of at least some of the tines 46 are parallel to one another. Preferably, the major axes of all of the tines 46 are parallel to one another. Adjacent tines 46 define spaces 81 configured to receive and separate the eyelashes as well as to receive the desired amount of product for the most efficient application to the eyelashes. The shape of the tines 46 employed will be determined by the desired degree of stiffness/flexibility, pay-off, loading, and other desired application characteristics. The cross-sectional shape of the tines 46 may be, for example, cylindrical, diamond-shaped or elliptoid. Preferably, the tines 46 will taper from their base ends 79 to their free ends 80.

Figure 7:
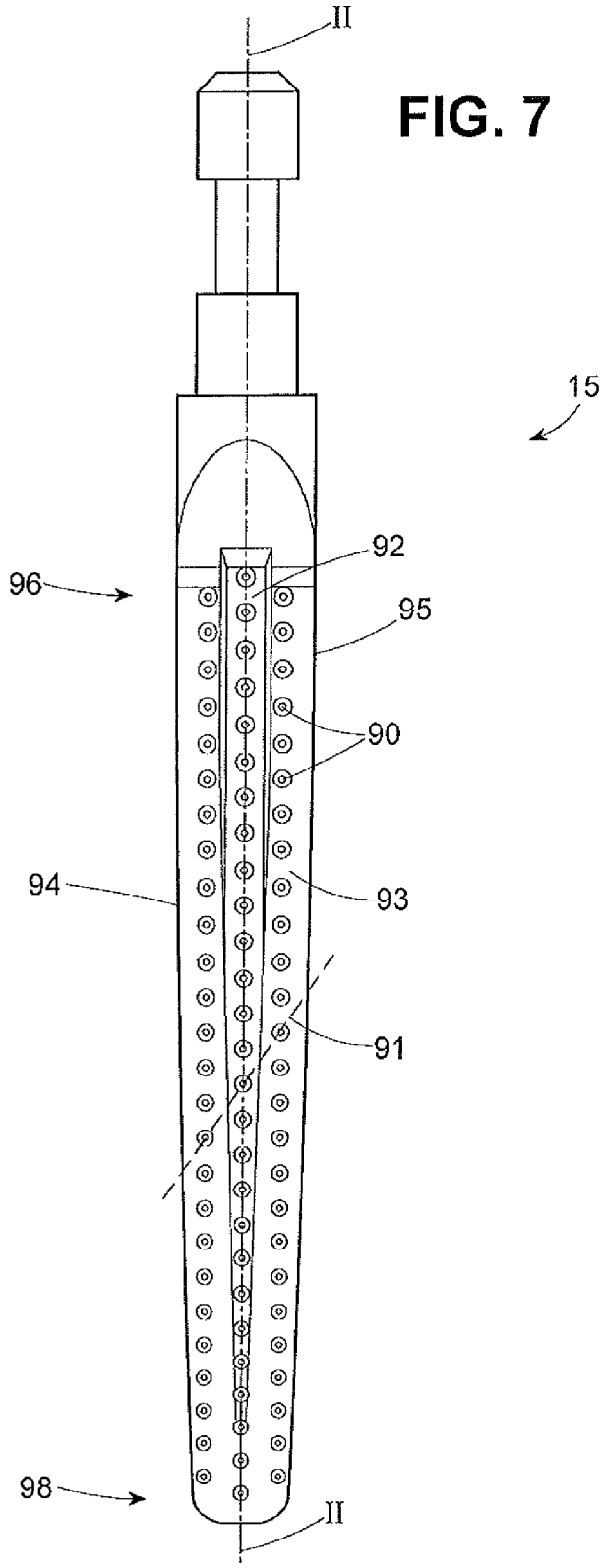
FIG. 7 is a top plan view of one embodiment of an applicator according to the present invention showing three longitudinal rows of tines and a channel in the support associated with one longitudinal row of tines for retaining cosmetic product.
Figure 8:
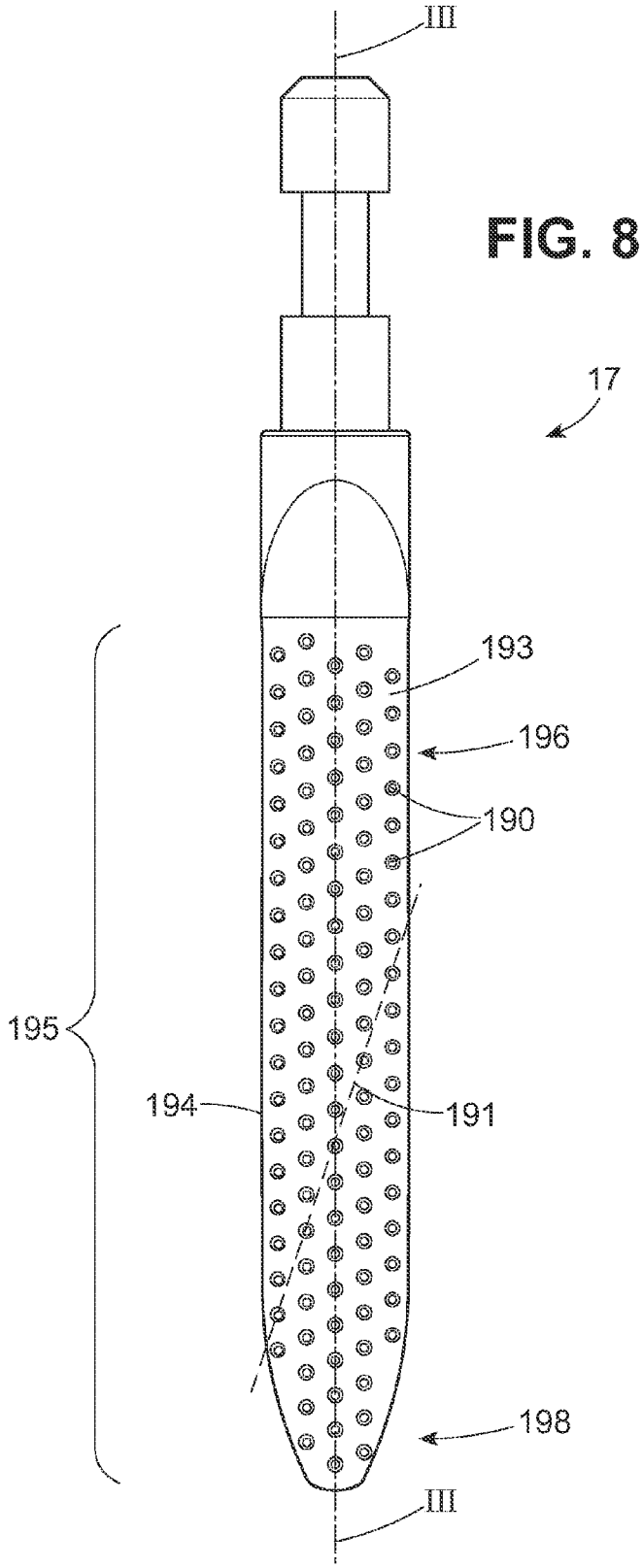
FIG. 8 is a top plan view of a further embodiment of an applicator according to the present invention showing five longitudinal rows of tines.

As shown in FIGS. 7 and 8, the tines 90, 190 of the applicator 15,17 extend in longitudinal rows 91,191 from the concave side 93,193 of support 94,194 along its longitudinal axis II,III. Three longitudinal rows 91 of tines 90 may be provided, as illustrated in FIG. 7. As shown in FIG. 8, five longitudinal rows 191 of tines 190 are provided. The tines 90,190 in each longitudinal row 91,191 may be longitudinally offset or staggered relative to the tines 90,190 in an adjacent row or rows 91,191. As shown in FIG. 7, at least one row 91 of tines 90 may be disposed in a channel 92 recessed in the support 94. The channel 92 is adapted to retain cosmetic material, for example, mascara, to promote the loading of the product onto the tines 90. Alternatively, in a further embodiment of the invention (not shown) the base of at least one tine in a longitudinal row may be associated with a reservoir recessed in the support.

The applicator head according to the present invention will generally have a width in the range of from about 1 to 12 mm, preferably in the range of from about 2 to 5 mm. For example, the applicator head may have a width at the proximal end in the range of from about 3 to 4 mm, and in the range of from about 2 to 3 mm at the distal end. As shown in FIGS. 7 and 8, at least one of the longitudinal rows 91,191 of tines 90,190 on the head 95,195 of applicator 15,17 may extend over a distance corresponding substantially to the total length of the support 94,194, such as, in the range of from about 20 to 35 mm, corresponding to the average length of the fringe of eyelashes of the top or bottom eyelid as measured from the inner to the outer corner, and will approximate the curve of the eye. Preferably, to more effectively reach the smallest lashes in the inner corners of the eyes, the support 94,194 will be tapered from the distal end 98,198 to the proximal end 96,196. It is also preferred that the distal end 98,198 be rounded to avoid injury or discomfort to the user. The width of the head of an applicator for use with a brow or hair product (not illustrated) generally will be in the range of from about 4 to 10 mm, preferably in the range of from about 6 to about 8 mm, and the longitudinal rows of tines may extend for a desired length approximately the average length of the eyebrow of a user and will approximate the curve of the eyebrow.

Figure 9:
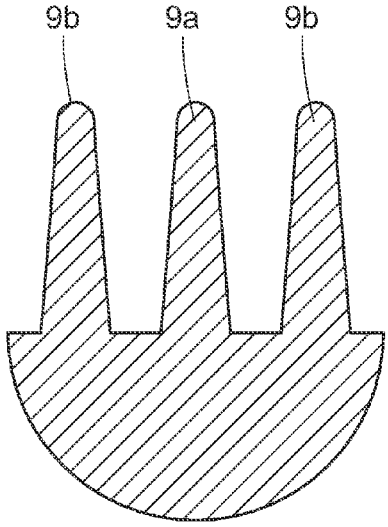
FIGS. 9-16 are end views of applicators according to the present invention.
Figure 10:
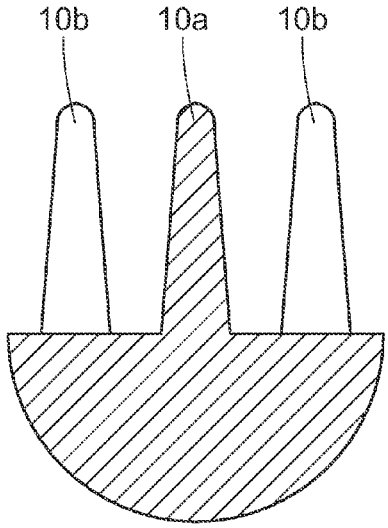
Figure 11:
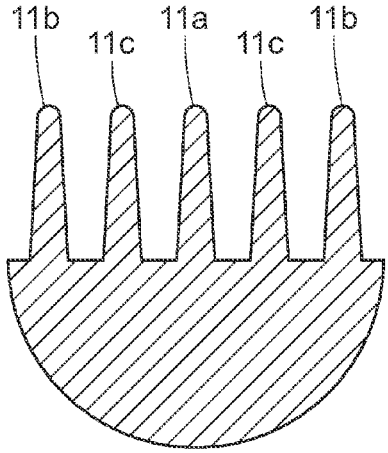
Figure 12:
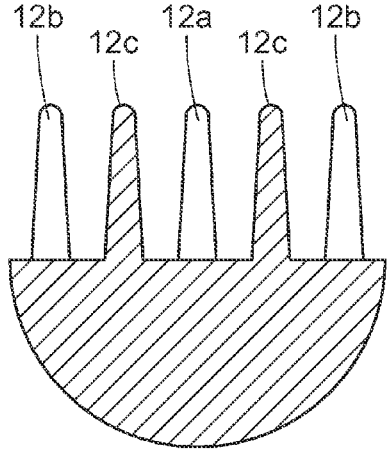

FIGS. 9-16 represent end views through the longitudinal axis of an applicator according to the present invention. All tines in the same longitudinal row overlap through that view. The tines arranged in the longitudinal rows on the applicator may be of a uniform height (FIGS. 9-12) or may vary in height (FIGS. 13-16). For example, as shown in FIG. 9, tines of a uniform height are arranged in three central and outer unstaggered rows 9*a*,9*b*, while in FIG. 10 the rows 10*a*,10*b* are staggered. FIG. 11 illustrates a further embodiment of the invention in which there are five central, outer and intermediate unstaggered rows 11*a*,11*b*,11*c* of tines of uniform height, while five staggered rows 12*a*,12*b*,12*c* are shown in FIG. 12. The height of the tines typically will be in the range of from about 1 to 4 mm, preferably in the range of from about 2 to 3 mm.

Figure 13:
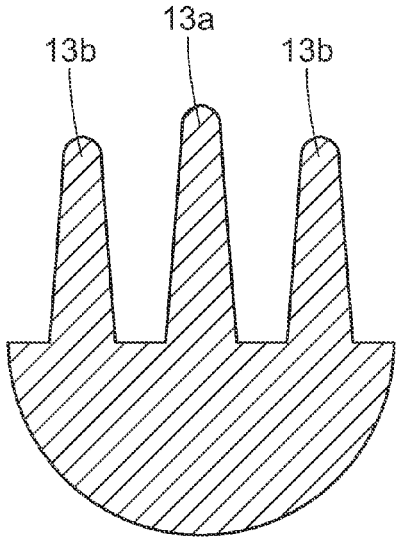
Figure 14:
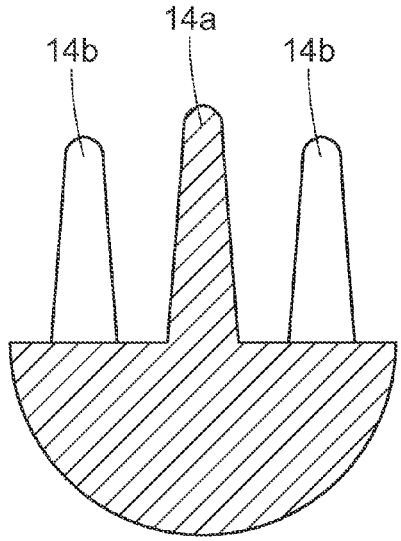
Figure 15:
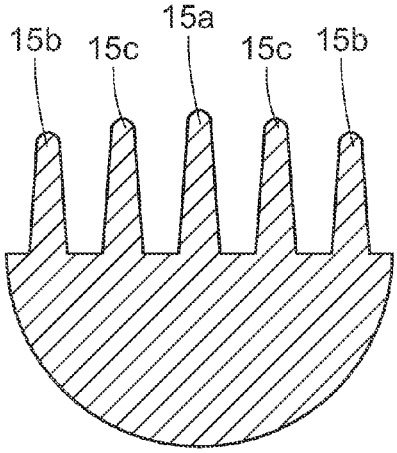
Figure 16:
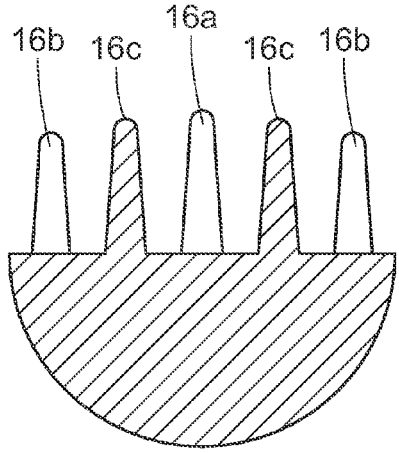
Figure 17:
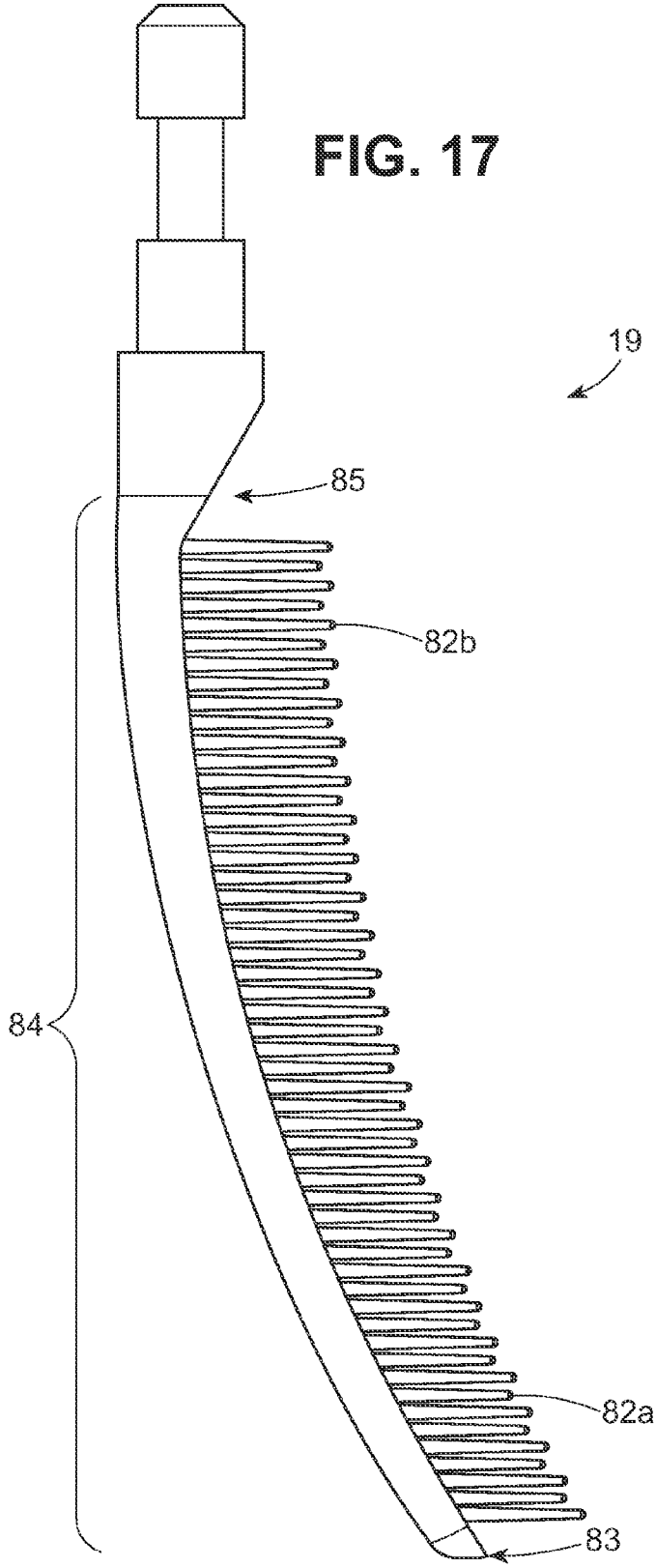
FIG. 17 is a side elevational view of a further embodiment of an applicator according to the present invention.

As shown in FIG. 13, tines of varying height are arranged in three longitudinal (central and outer) unstaggered rows 13*a*,13*b*, while in FIG. 14, the rows 14*a*,14*b* are staggered. The tines in the central row 13*a*,14*a* have a greater height than do the tines in the outer rows 13*b*,14*b*. Alternatively, the tines are arranged in five parallel unstaggered or staggered rows as illustrated in FIGS. 15 and 16. The heights of the tines in the central row 15*a*,16*a* are greater than the heights of the tines in the outer rows 15*b*,16*b* and the heights of the tines in the intermediate rows 15*c*,16*c* are of a height between the heights of the tines in the central and outer rows. For example, the tines in the central rows may have the greatest height, for example, in the range of about 1 to about 4 mm, preferably in the range of from about 3 to 4 mm, while the shortest tines, in the outer rows, may have a height in the range of from about 0.5 mm to about 2 mm, preferably from about 1 mm to 2 mm. Tines in the intermediate rows may have a height between the heights of the tallest and shortest tines, for example, in the range of from about 2 to 3 mm. FIG. 17 illustrates a further applicator according to the present invention. The heights of the tines 82*a* at the distal end 83 of the support 84 of applicator 19 will have a lesser height as compared with the heights of the tines 82*b* at the proximal end 85 of the support 84. For example, the heights of the tines 82*b* at the proximal end 85 may have a height in the range of about 3 to 4 mm, while the tines 82*a* at the distal end 83 may be in the range of from about 0.5 to about 2 mm to more effectively contact the tiniest lashes in the inner corners of the eyes.

The rows of parallel tines are manufactured integrally as a single molded piece with the support, of a single resilient material, by injection or compression molding, for example, a plastics/polymer material, an elastomer or a liquid injection molded (LIM) silicone elastomer. For compression molding, the use of thermoplastic elastomers is preferred; however, polyesters, polyethylenes, and/or polyurethanes may also be used. For injection molding, thermoplastic or thermoset materials may be utilized, including, polyurethanes, polyesters and thermoset elastomers (TSEs), such as silicones. A particularly preferred thermoplastics resin for injection molding is Hytrel® (DuPont), a polyether ester elastomer block polymer. Molding materials may also include antibacterial agents, for example Triclosan® and/or product performance-enhancing and/or shelf-life-enhancing agents, such as plasticizers to improve flexibility and reduce the occurrence of cracking over time, and fluorination agents to provide a barrier layer over hygroscopic plastics. In one embodiment of the present invention, the applicator comes out of the molding press ready to be mounted to a rod by means of mechanical and/or adhesive connection. In accordance with an alternative embodiment of the invention, the applicator comes out of the molding press fully assembled and suitable for mounting as a single unit to the cap.

Although the present invention has been described herein with reference to particular embodiments, it is to be understood that these embodiments are merely illustrative of certain principles and applications of the present invention. It is further to be understood that numerous modifications may be made to the illustrative embodiments and that other arrangements may be devised without departing from the present invention.

The invention claimed is:

1. An applicator for applying a cosmetic to keratinous material, the applicator having a longitudinal axis and being of single-piece molded unit construction, and including a head portion comprising a support and at least two rows of tines, the support having a distal end and a proximal end and defining a radius of curvature, substantially the entirety of the head portion curving forward of the longitudinal axis, and the support having first and second opposite sides, and the at least two rows of tines being disposed along the first side of the support and projecting away from the first side of the support in a direction perpendicular to said longitudinal axis, the second side of the support being smooth and free from tines, wherein major axes of all of the tines are parallel to one another, and the tines are arranged to define spaces configured to receive and separate the eyelashes and to receive and deliver the desired amount of product to the keratinous material, and the applicator being formed of a single material.

2. The applicator of claim 1 wherein the tines are arranged in staggered rows.

3. The applicator of claim 2 wherein the tines are arranged in three staggered rows.

4. The applicator of claim 2 wherein the tines are arranged in five staggered rows.

5. The applicator of claim 1 wherein the radius of curvature is in the range of from about 20 mm to about 1000 mm.

6. The applicator of claim 5 wherein the radius of curvature of the support is in the range of from about 30 mm to about 60 mm.

7. The applicator of claim 1 wherein the support has a length in the range of from about 5 mm to about 35 mm.

8. The applicator of claim 7 wherein the support has a length in the range of from about 20 mm to about 30 mm.

9. The applicator of claim 7 wherein the tines extend over substantially the entire length of the support.

10. The applicator of claim 1 further comprising a rod extending from the proximal end of the head portion in a direction along the longitudinal axis of the applicator, and the head portion deviating asymmetrically from the longitudinal axis.

11. The applicator of claim 10, wherein the rod is adapted to be secured to a cap for a cosmetic package.

12. The applicator of claim 10 wherein the rod is molded integrally with the applicator.

13. The applicator of claim 10 wherein the head portion of the applicator is connected to the rod by mounting means.

14. The applicator of claim 13 wherein the mounting means comprise a mounting post on one of the support and the rod and a bore on the other of the support and the rod to receive the post, the mounting post having a circumferential groove defining 90° surfaces located along the length of the mounting post.

15. The applicator of claim 1 in which the support has a width ranging from about 1 mm to about 12 mm.

16. The applicator of claim 15 in which the support has a width ranging from about 2 mm to about 5 mm.

17. The applicator of claim 15 in which the width of the support tapers from the proximal end to the distal end.

18. The applicator of claim 1 in which the tines have a height in the range of about 1 mm to about 4 mm.

19. The applicator of claim 1 in which the tines have a cylindrical cross-section.

20. The applicator of claim 1 which is configured from injection or compression molded plastics, elastomer or liquid injection molded (LIM) elastomer.

21. The applicator of claim 1 which is adapted for the application of a cosmetic eyelash or eyebrow product, a hair product, a treatment product or a pharmaceutical product.

22. A packaging and applicator device for applying a product to keratinous material, comprising:

a receptacle for containing the product; and an applicator according to claim 10.

23. A device according to claim 22 further comprising a wiper member.

24. A device according to claim 22 further including a cap for the receptacle, and wherein the applicator is configured to be housed inside the receptacle when the device is in its closed position.

25. The applicator according to claim 1 wherein the first side of the support has a concave surface.

* * * * *